US009277606B2

(12) United States Patent
Gong et al.

(10) Patent No.: US 9,277,606 B2
(45) Date of Patent: Mar. 1, 2016

(54) PROPAGATION DELAY COMPENSATION FOR FLOATING BUCK LIGHT EMITTING DIODE (LED) DRIVER

(71) Applicant: Infineon Technologies Austria AG, Villach (AT)

(72) Inventors: Xiaowu Gong, Singapore (SG); Kok Kee Lim, Singapore (SG); Yong Siang Teo, Singapore (SG)

(73) Assignee: Infineon Technologies Austria AG, Villach (AT)

( * ) Notice: Subject to any disclaimer, the term of this patent is extended or adjusted under 35 U.S.C. 154(b) by 0 days.

(21) Appl. No.: 14/304,638

(22) Filed: Jun. 13, 2014

(65) Prior Publication Data

US 2015/0366007 A1 Dec. 17, 2015

(51) Int. Cl.

| | |
|---|---|
| ***H05B 33/08*** | (2006.01) |
| ***H05B 37/02*** | (2006.01) |
| ***H05B 41/282*** | (2006.01) |
| ***H05B 41/392*** | (2006.01) |

(52) U.S. Cl.

CPC ..... *H05B 33/0809* (2013.01); *H05B 33/0815* (2013.01); *H05B 33/0818* (2013.01); *H05B 37/0281* (2013.01); *H05B 41/2828* (2013.01); *H05B 41/3921* (2013.01)

(58) Field of Classification Search

CPC ..... H05B 33/0815; H05B 33/0818; H05B 41/2828; H05B 41/3921; H05B 41/3927

See application file for complete search history.

(56) References Cited

U.S. PATENT DOCUMENTS

| | | | | |
|---|---|---|---|---|
| 3,619,511 | A * | 11/1971 | Ishikawa | 370/202 |
| 6,008,586 | A * | 12/1999 | Norman | 315/94 |
| 7,142,486 | B2 * | 11/2006 | Masui et al. | 369/44.29 |
| 8,247,986 | B2 * | 8/2012 | Su et al. | 315/247 |

* cited by examiner

*Primary Examiner* — Vibol Tan

(74) *Attorney, Agent, or Firm* — Shumaker & Sieffert, P.A.

(57) ABSTRACT

Devices, systems, and methods for improving a current spread of a light emitting diode (LED). Some aspects including a peak detector and a variable gain amplifier coupled to the peak detector and configured to amplify an output of the peak detector. The variable gain amplifier controlled by a gain selector, coupled to the variable gain amplifier by varying the gain of the variable gain amplifier based on an on time of a signal.

20 Claims, 10 Drawing Sheets

PROPAGATION DELAY COMPENSATION FOR FLOATING BUCK LIGHT EMITTING DIODE (LED) DRIVER

TECHNICAL FIELD

This disclosure relates to drivers, and more particular, to techniques and circuits associated with light emitting diode (LED) drivers.

BACKGROUND

A light-emitting diode (LED) is a two-lead semiconductor pn-junction (diode) that also a emits light. When the anode lead of an LED has a voltage that is positive relative to the cathode of the LED by more than the LED's forward voltage drop, current flows through the LED. LEDs exhibit electroluminescence, which is an optical phenomenon and electrical phenomenon in which a material emits light in response to the passage of an electric current or to a strong electric field.

Generally, a resistor may be used to regulate current through an LED. However, this may waste power because as current flows through the resistor and the LED the resistor will generally dissipate some of the energy of the current flow as heat. In order to avoid some of the losses in the resistor, an LED may be powered by an LED driver. The LED driver may provide current to the LED using, for example, a switched mode power supply, such as a buck converter, or other power source.

SUMMARY

In general, techniques and circuits are described that may improve a spread of an output light emitting diode (LED) current by introducing a variable gain at a $V_{COMP}$ amplifier. In some examples, the gain of the $V_{COMP}$ amplifier may be dependent on the on time, $t_{ON}$, of a power transistor. When the on time, $t_{ON}$, of the power transistor is short, the propagation delay will become a larger proportion of the $t_{ON}$. As a result, the measured output LED current may be higher than the actual LED current. Hence, when $t_{ON}$ is short, the gain may be higher to compensate for the propagation delay.

In one example, the disclosure is directed to a device including a peak detector, a variable gain amplifier coupled to the peak detector and configured to amplify an output of the peak detector, and a gain selector, coupled to the variable gain amplifier and configured to control the variable gain amplifier by varying the gain of the variable gain amplifier based on an on time of a signal.

In another example, the disclosure is directed to a system including an LED coupled, a power transistor coupled to the LED and configured to provide power to the LED, a device coupled to the power transistor, the device including a peak detector, a variable gain amplifier coupled to the peak detector and configured to amplify an output of the peak detector, and a gain selector, coupled to the variable gain amplifier and configured to control the variable gain amplifier by varying the gain of the variable gain amplifier based on an on time of the LED.

In another example, the disclosure is directed to a system including a device for controlling a current to an LED comprising means for detecting a peak of a signal, means for selecting a gain for a variable gain amplifier based on an on-time signal, and means amplifying the detected peak of the signal.

In another example, the disclosure is directed to a system including a method of controlling a current to an LED including detecting a peak of a signal, selecting a gain for a variable gain amplifier based on an on-time signal, and amplifying the detected peak of the signal.

The details of one or more examples are set forth in the accompanying drawings and the description below. Other features, objects, and advantages of the disclosure will be apparent from the description and drawings, and from the claims.

DETAILED DESCRIPTION

This disclosure describes systems, methods, and devices for improving the spread of an output current of a light source. An example light source includes a semiconductor light sources such as a light emitting diode (LED). In an example, the spread of an output light source current may be improved by introducing a variable gain at a $V_{COMP}$ amplifier. In some examples, the gain of the $V_{COMP}$ amplifier may be dependent on the on time, $t_{ON}$, of a power transistor. When the on time, $t_{ON}$, of the power transistor is short, the propagation delay will become a larger proportion of the $t_{ON}$. As a result, the measured output current may be higher than the actual current. For example, if the light source is a semiconductor light source such as an LED, the measured output LED current may be higher than the actual LED current. Hence, when $t_{ON}$ is short, the gain may be higher to compensate for the propagation delay.

Some examples may include a peak detector, a variable gain amplifier coupled to the peak detector and configured to amplify an output of the peak detector, and a gain selector, coupled to the variable gain amplifier and configured to control the variable gain amplifier by varying the gain of the variable gain amplifier based on an on time of a signal.

In some examples, the gain selector may include analog circuitry. In some examples, the gain selector includes digital circuitry. In some examples, the gain selector includes analog circuitry and digital circuitry. The device may include an on-time detector configured to measure the on time of the signal. A gain selector may increase the gain of the variable gain amplifier when the on time is short. The short on time, in one example, may be a range of from 0 to 5.4 microseconds.

Figure 1:
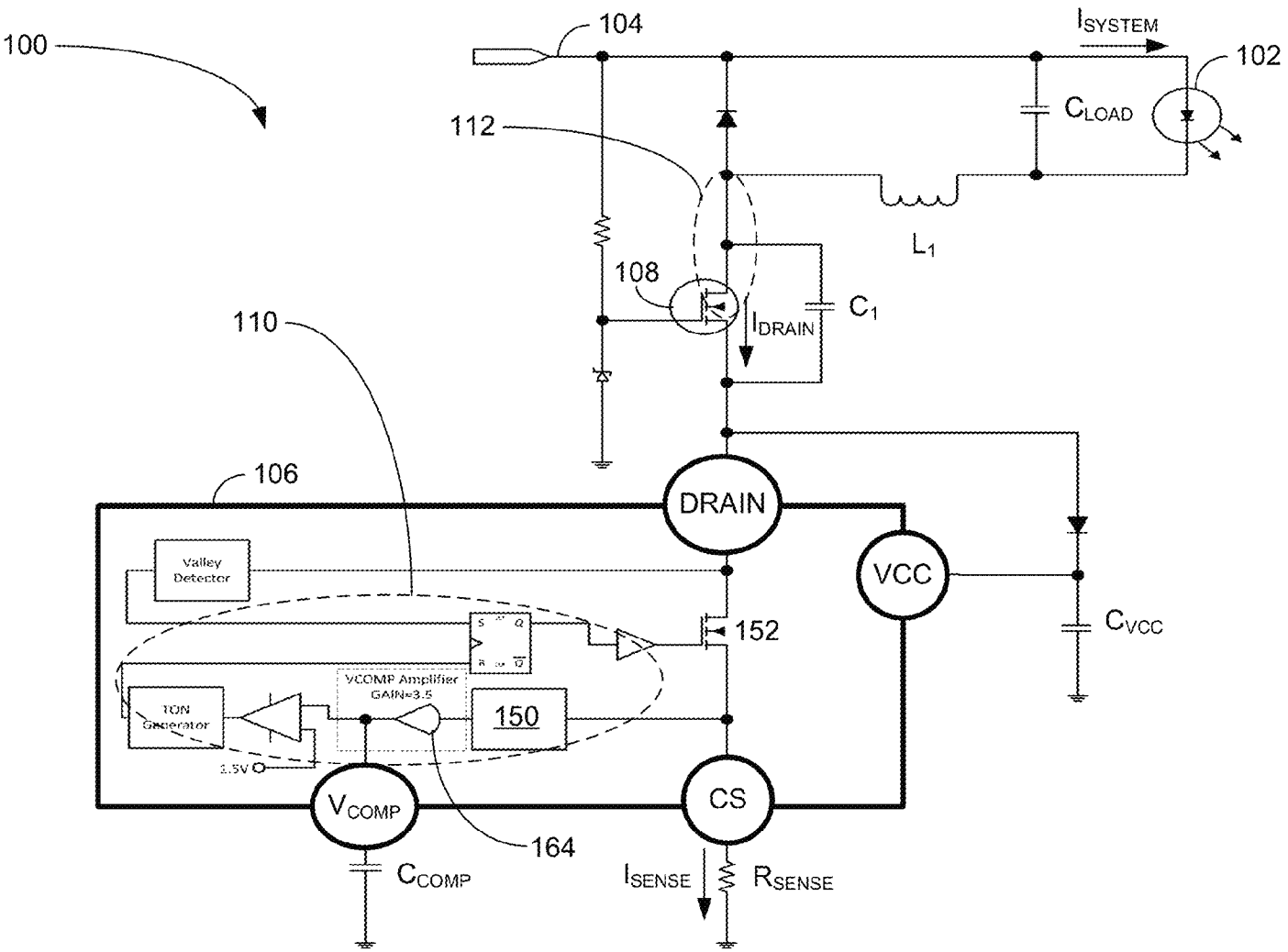
FIG. 1 is a block diagram that illustrates an example floating buck light emitting diode (LED) driver topology that may incorporate one or more of the systems and methods described herein.

FIG. 1 is a block diagram illustrating an example floating buck light emitting diode (LED) driver 100 topology that may incorporate one or more of the systems and methods described herein. The illustrated example includes an LED 102. In the illustrated example, LED 102 is a single LED. In other examples, multiple LEDs may be used. The LEDs may be in series, in parallel, or some combination of series and parallel LEDs. In the illustrated example, LED 102 may have a regulated output current that will change significantly depending on the input voltage 104 and the choke inductance, $L_1$.

The floating buck LED driver 100 topology includes circuitry to regulate the current, $I_{SYSTEM}$, through LED 102. As part of regulating the current sense the current flowing through LED 102, $I_{SYSTEM}$, is sensed to determine the current flow. Circuitry to perform the current flow determination includes integrated circuit (IC) 106, resistor $R_{SENSE}$, and capacitors $C_{COMP}$ and $C_{VCC}$. The current flowing through the LED may be sensed using resistor $R_{SENSE}$. The current flowing through resistor $R_{SENSE}$ will cause a voltage at IC 106 input CS. Peak detector 150 measures the peak voltage at CS and holds that value. The value of the detected peak may be held for approximately 0.8 us to 44 us, for example, however a wide range of hold times may be used. The $V_{COMP}$ amplifier may then amplify the peak voltage held.

Capacitor $V_{COMP}$ may smooth out the voltage output from $V_{COMP}$ amplifier 164 and a comparator circuit may compare the voltage output from $V_{COMP}$ amplifier 164 to a reference voltage. In the illustrated example of FIG. 1, the reference voltage is 1.5 volts; however, a wide range of voltage values may be used depending on a wide variety of factors, including input voltage, the LED or LEDs used desired brightness, etc. Depending on the specific implementation, the compare voltage may vary between ground and the supply voltage, for example assuming a system having a ground voltage and an input voltage. For systems having both a positive supply voltage and a negative supply voltage, the reference voltage may generally vary between these voltages in some examples.

When the voltage $V_{COMP}$ is greater than the reference voltage the on time, $t_{ON}$ is or will be decreased. When the voltage $V_{COMP}$ is less than the reference voltage the on time, $t_{ON}$ is or will be increased. For example, as illustrated in FIG. 1, when the voltage, $V_{COMP}$ is greater than 1.5 volts, the on time, $t_{ON}$, will be decreased and when the voltage V is less than 1.5 volts the on time, $t_{ON}$, will be increased. The $t_{ON}$ Generator 160 may generate the on time, $t_{ON}$, by comparing $V_{COMP}$ voltage to the reference voltage.

Increasing the on time, $t_{ON}$, will increase LED 102 current. Decreasing the on time, $t_{ON}$, will decrease LED 102 current. In some examples, the LED current may be the average current through the LED. The LED may be powered by turning the current on and off. Generally, the longer the current is on the brighter the LED and the shorter the current is on the more dim the LED will be. It will be understood that, at some point, the LED current may be on for such a short duration that the light from the LED may not be visible to the human eye. It will further be understood that, at some point, the LED current may be on for such a long duration that the LED may be damaged. Valley Detector 162 may determine when the voltage across a power transistor such as external power MOSFET 308 is at its lowest voltage level based on the voltage input at the drain input pin of IC 106. This may be used to determine when to turn the current through LED 102 on. For examples, $t_{ON}$ may be dependent on the voltage across the external power MOSFET 308 such that when the voltage across external power MOSFET 308 is at its lowest voltage level, e.g., 0.0V. When the voltage across external power MOSFET 308 is at its lowest voltage the current across inductor $L_1$ is zero.

In some examples, a constant average may be obtained, or approximately obtained, trying to average the charging up and the discharging of inductor $L_1$. In some examples, the $t_{ON}$ may depend on the input voltage, the inductance $L_1$, and the number of LEDs used. When input voltage is high, $t_{ON}$ may be shorter, when output voltage is high, $t_{ON}$ may be longer. When inductor, $L_1$, is large, $t_{ON}$ may be longer.

One issue that may sometimes arise in systems such as the system illustrated in FIG. 1 is that propagation delay may impact the operation of the circuitry. There are two main factors that may contribute to the changes in the output current. The first contributing factor is due to the internal propagation delay at IC 106. The internal propagation delay at IC 106 may generally be related to circuitry within or near area 110. The second contributing factor affecting the output current is the propagation delay from external power MOSFET 108 turn off to the inductor current $L_1$ starts to discharge. The propagation delay related to external power MOSFET 108 may generally be related to circuitry within or near area 112.

For the first contributing factor, the internal propagation delay at IC 106, when circuitry internal to IC 106 turns off the gate of the internal power MOSFET 152, peak detector 150 may stop sampling the peak. However, there is a propagation delay between the internal power MOSFET 152 turn off and when the peak detector 150 stops sampling. This propagation delay may cause the peak sampled to be lower than the actual value because the peak detector 150 may take one or more samples as or after internal power MOSFET 152 is turning off when it is disconnecting or no longer connected to a valid voltage source. This incorrect voltage reading caused by the internal propagation delay at IC 106 may regulate the output current to a higher value than is actually intended.

The second contributing factor affecting the output current is the propagation delay from external power MOSFET 108 turn off to when inductor $L_1$ current starts to discharge. The delay from external power MOSFET 108 turn off to when inductor $L_1$ current starts to discharge may be due to the time taken for the drain of external power MOSFET 108 to rise the diode forward voltage above the input voltage. The diode forward voltage is commonly referred to as the "diode drop." A typical value for the diode forward voltage for a silicon diode is 0.7 volts. Other semiconductor materials may have different diode forward voltages.

Figure 2:
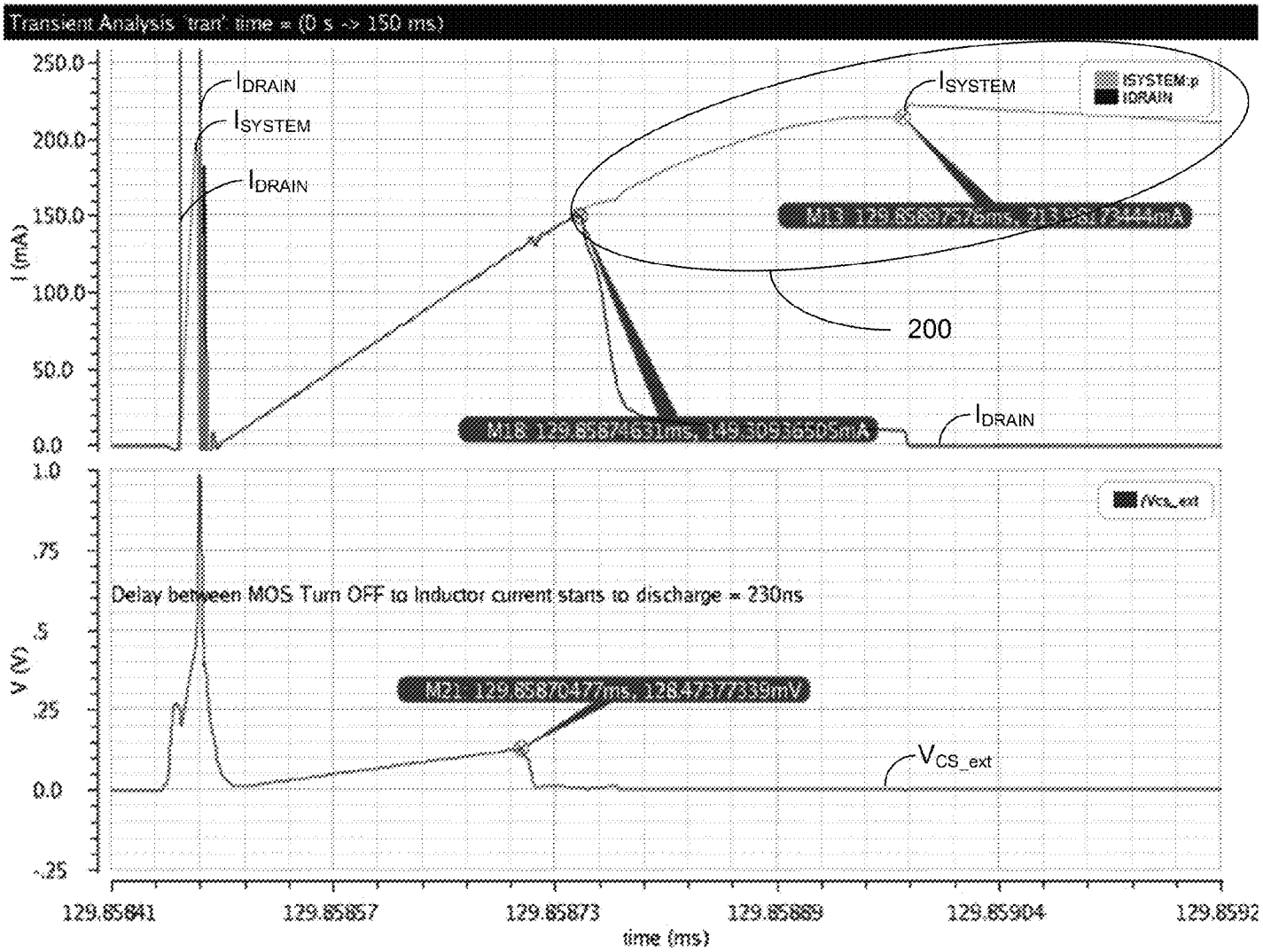
FIG. 2 is a diagram that illustrates example current flow and voltage waveforms related to various components of FIG. 1.

FIG. 2 is a diagram illustrating example current flow waveforms through various components of FIG. 1. More specifically, FIG. 2 illustrates the current flow waveforms through external power MOSFET 108 ($I_{DRAIN}$), the voltage at the CS pin of IC 106, which is the current through the $R_{SENCE}$ resistor ($I_{SENSE}$) multiplied by the value of the $R_{SENCE}$ resistor in ohms, and the current flowing to LED 102 ($I_{SYSTEM}$) from the input. The current to charge the drain of external power MOSFET 108 may result in a delay in the system, which may cause the actual peak current to be higher than the sensed peak current. As illustrated in FIG. 2, excess current 200 may flow to the output, i.e., output current, $I_{LED}$, due to the high current slew rate if the inductor value is small. Accordingly, there may be a spread between the actual output current and the measured output current. Additionally, the output current spread between the measured current and the actual current may be worse when $t_{ON}$ is short. This is because, when $t_{ON}$ is short, the delays discussed with respect to FIG. 1 make up a larger percentage of the time, $t_{ON}$. When $t_{ON}$ is short, the spread is larger and the output current is higher. When $t_{ON}$ is longer, the output current is nearer to what is measured.

Referring back to FIG. 1, the spread in the output current may be reduced by reducing the value of the $C_1$. By reducing the value of $C_1$, the voltage at the drain of external power MOSFET 108 can rise faster from a low voltage to a diode drop above the input voltage 104. As result, the reduced delay may cause an error between the actual peak current and the sensed peak current to be lowered. However, reducing the value of $C_1$, may have disadvantages in some cases. For example, reducing the value of $C_1$, may reduce the error due to the delay caused by the parasitic at the drain of the external power MOSFET 108, but the error due to the second contributing factor, which is the propagation delay from external power MOSFET 108 turn off to when inductor $L_1$ current starts to discharge, will not be resolved. Furthermore, there is a limit at how much we can reduce $C_1$. For low values of $C_1$, valley detection is more difficult. Also, $C_1$ is used to charge $C_{VCC}$. If $C_1$ is too low, there will be not enough energy to maintain the correct voltage at the $V_{CC}$ input to IC 106.

Figure 3:
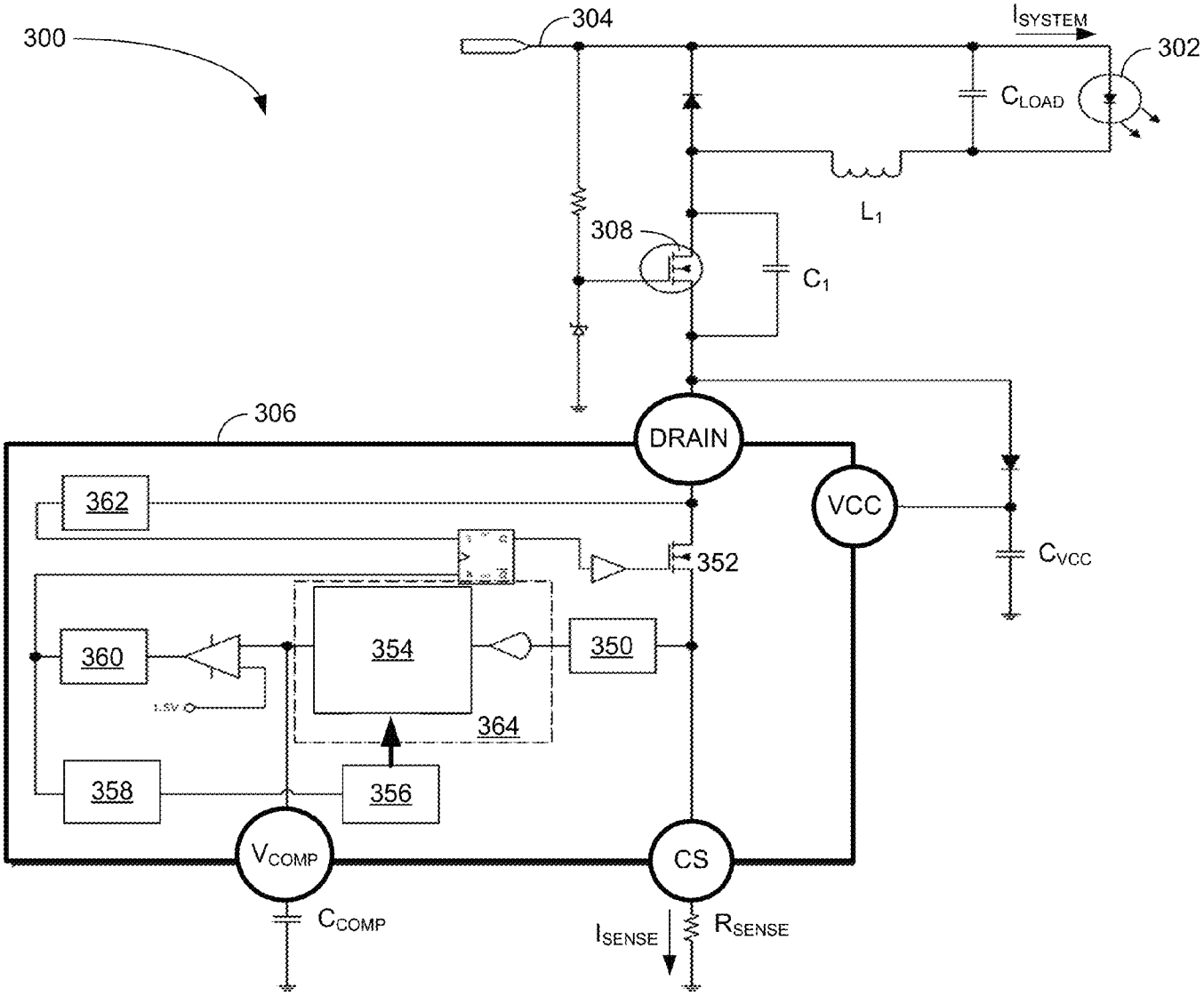
FIG. 3 is a block diagram that illustrates an example floating buck LED driver topology in accordance with one or more aspects of the present disclosure.

FIG. 3 is a block diagram illustrating an example floating buck LED driver 300 topology in accordance with one or more aspects of the present disclosure. The illustrated example includes an LED 302. In the illustrated example, LED 302 is a single LED. In other examples, multiple LEDs may be used. The LEDs may be in series, in parallel, or some combination of series and parallel LEDs.

The illustrated example also includes input voltage 304, IC 306, external power MOSFET 308. IC 306 includes peak detector 350, internal power MOSFET 352, $t_{ON}$ Generator 360, Valley Detector 362, and a variable gain $V_{COMP}$ amplifier 354. The variable gain $V_{COMP}$ amplifier 354 may be part of circuitry 364 that may include a buffer between peak detector 350 and variable gain $V_{COMP}$ amplifier 354.

Valley detector 362 may be used to determine a minimum value for the current through inductor $L_1$, which may, in turn be used, in conjunction with the $t_{ON}$ Generator 360 output to control internal power MOSFET 352 (through a SR latch and buffer circuitry). As illustrated in FIG. 3, the buffered output of a SR latch may control the internal power MOSFET 352 such that internal power MOSFET is on when the SR latch is set by valley detector 362 and reset by $t_{ON}$ Generator 360.

The example floating buck LED driver 300 topology of FIG. 3 is generally similar to the example floating buck LED driver 100 topology of FIG. 1, however, the variable gain $V_{COMP}$ amplifier 354 is a variable gain amplifier. Additionally, the example floating buck LED driver 300 topology includes, Gain Selector 356, and $t_{ON}$ detector 358, which may be used in accordance with one or more aspects of the present disclosure. Gain Selector 356 may control the gain of the variable gain $V_{COMP}$ amplifier 354. On-time ($t_{ON}$) detector 358 may detect on time. Accordingly, on-time $t_{ON}$ detector 358 may provide an on-time signal to indicate the on-time, $t_{ON}$. When $t_{ON}$ is shorter, the gain of the variable gain $V_{COMP}$ amplifier 354 may be increased. By increasing the gain of the variable gain $V_{COMP}$ amplifier 354, the output of $V_{COMP}$ amplifier 354 may reach the reference voltage sooner, i.e., for a lower voltage input on the input of $V_{COMP}$ amplifier 354. This translates to a lower output current value for a given comparison. Accordingly, the average output current will be lower for a shorter $t_{ON}$. Generally, in a system without variable gain for the $V_{COMP}$ amplifier (e.g., $V_{COMP}$ amplifier 164), a lower value for $t_{ON}$ will generally have a higher output current than measured, as is discussed in more detail with respect to FIG. 7. Accordingly, gain selector 356 may increase the gain of the variable gain $V_{COMP}$ amplifier 354 such that a lower output current value for a given comparison is closer to the actual output current. Gain selector 356 may vary the gain of $V_{COMP}$ amplifier 354 between lower values of $t_{ON}$ will and longer values of $t_{ON}$ such that the output current measured is generally closer to the actual output current.

Thus, some examples in accordance with the systems and methods described herein may improve the spread of the output LED current by introducing a variable gain at $V_{COMP}$ amplifier 354. In the illustrated example of FIG. 3, IC 306 may be a variable gain $V_{COMP}$ amplifier 354. Gain Selector 356 may control the gain of the variable gain $V_{COMP}$ amplifier 354. The $t_{ON}$ Detector 358 may sense $t_{ON}$ to determine the on time.

The gain of variable gain $V_{COMP}$ amplifier 354 may be dependent on the "on time" of the gate of internal power MOSFET 352, i.e., the time when the voltage on the gate is sufficient to turn on the transistor, internal power MOSFET 352. When the on time is short, the propagation delay will become a larger proportion of $t_{ON}$. As a result, the measured output LED current is higher than the actual LED output current. Hence, in some examples of the systems and methods described herein, when $t_{ON}$ is short, the gain may be higher to compensate for the propagation delay.

Additionally, as illustrated in FIG. 3, some examples of the systems and methods described herein may not require additional components. The components external to IC 306 may generally be the same. Furthermore, while the general topology of IC 306 may be different, it may still be a single component. The different components used to implement the systems and methods described herein may be on a single die of IC 306.

In some examples, the spread in the output current may also be reduced by reducing the value of the $C_1$. In the example of FIG. 3, however, the reduction in capacitance value of $C_1$ may be less than the reduction in capacitance value of $C_1$ for FIG. 1 because of the introduction of the variable gain at variable gain $V_{COMP}$ amplifier 354. As described herein, the gain of variable gain $V_{COMP}$ amplifier 354 may be dependent on the on time of the gate of external power MOSFET 308. When the on time is short, the propagation delay will become a larger proportion of the $t_{ON}$. As a result, the output LED current may be higher. Accordingly, when $t_{ON}$ is short, the gain may be selected to be higher to compensate for the propagation delay.

In some examples no additional bill of materials cost is incurred. In some cases, no additional parts are needed. Rather, additional functionality may be implemented on a single die of a single chip, e.g., IC 306. The spread of the output current can be adjusted by slightly adjusting the value of the $C_1$. This adjustment to $C_1$ may be made to compensate for an overall system propagation delay that might be lower than the built in propagation delay compensation. However, generally, there will be no need for large reduction in the $C_1$ value because of the gain changes used. Hence, there is no impact on valley detection and VCC in some examples. Additionally, some examples may allow the use of low choke inductance value.

Figure 4:
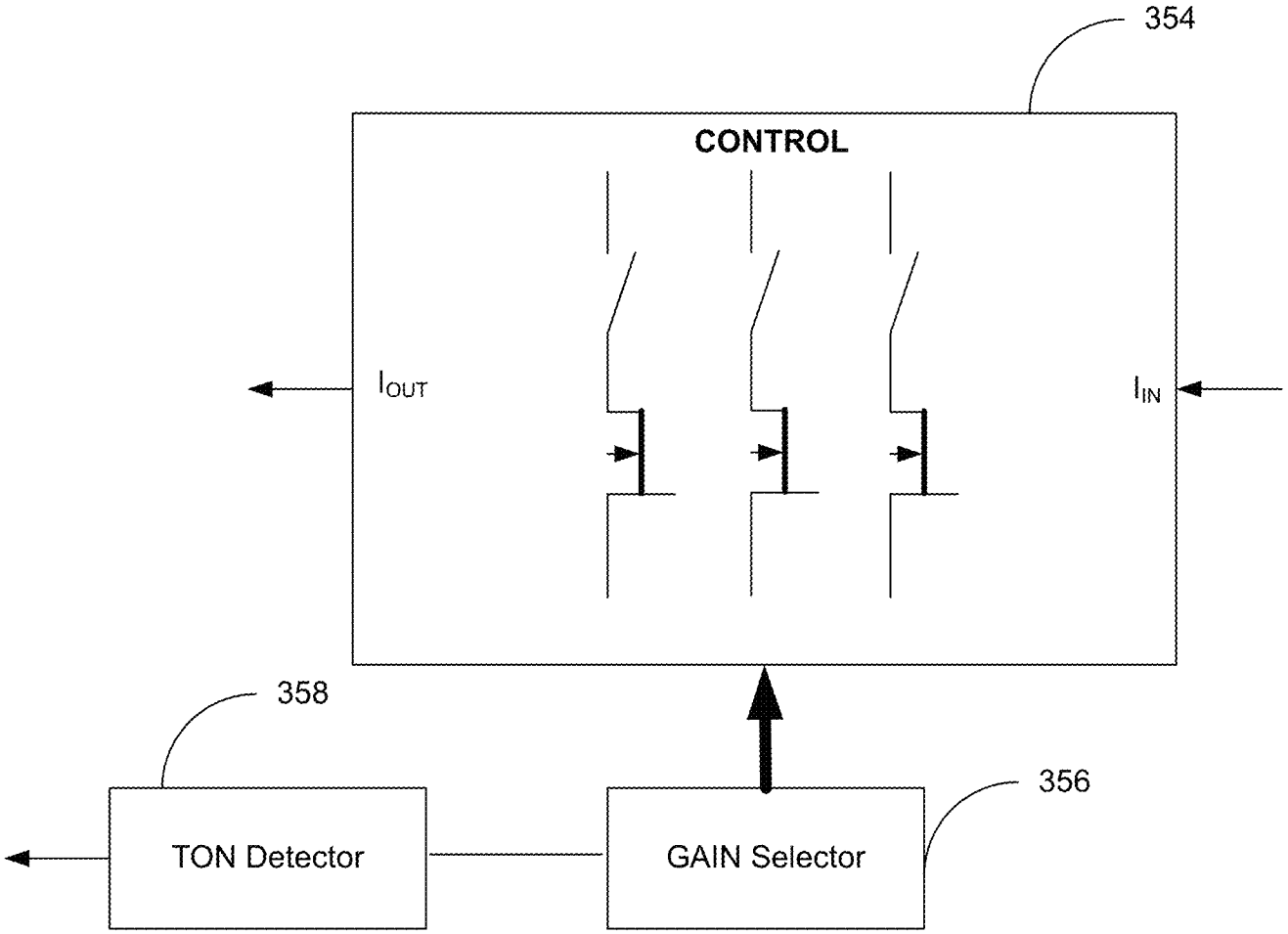
FIG. 4 is a block diagram that illustrates the control circuitry, gain selector, and on time ($t_{ON}$) detector of FIG. 3 in accordance with one or more aspects of the present disclosure.

FIG. 4 is a block diagram illustrating the control circuitry, gain selector, and $t_{ON}$ detector of FIG. 3 in accordance with one or more aspects of the present disclosure. Gain Selector 356 may control the gain of the variable gain $V_{COMP}$ amplifier 354. In some examples, the variable gain $V_{COMP}$ amplifier 354 may include a series of transistor switches. The transistor switches may select the appropriate gain. The $t_{ON}$ Detector 358 may sense $t_{ON}$.

Figure 5:
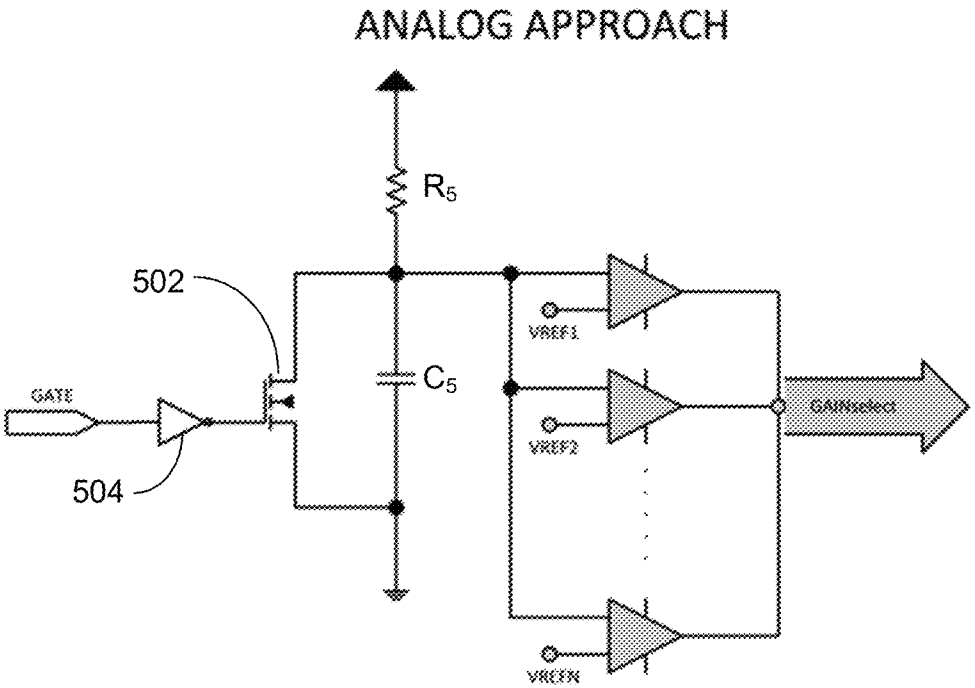
FIG. 5 is a block diagram that illustrates circuitry related to an analog approach in accordance with one or more aspects of the present disclosure.
Figure 6:
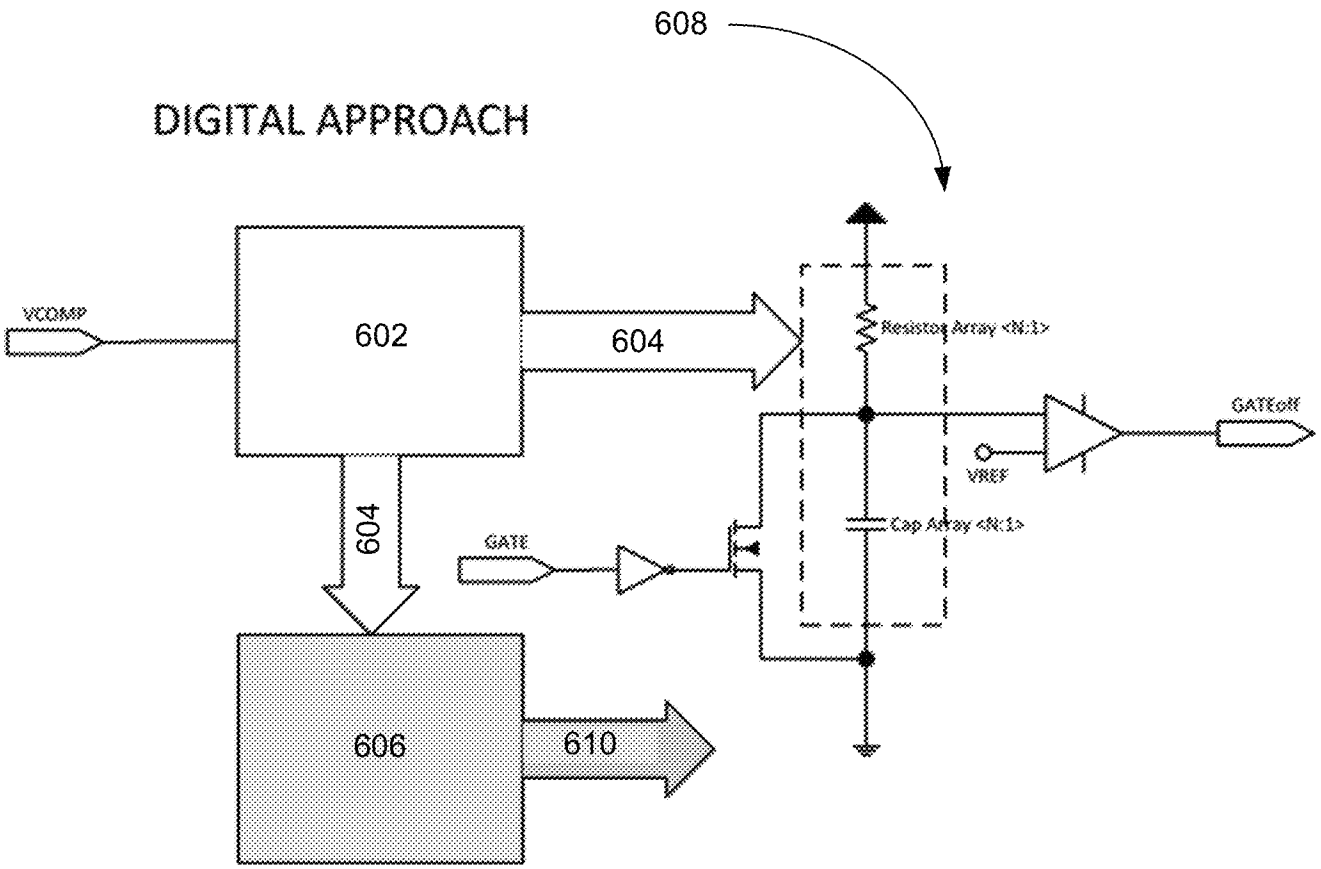
FIG. 6 is a block diagram that illustrates circuitry related to a digital approach in accordance with one or more aspects of the present disclosure.

As described herein some examples may use an analog approach and some examples may use a digital approach. FIG. 5 is a block diagram that illustrates analog circuitry related to an analog approach in accordance with one or more aspects of the present disclosure. FIG. 6 is a block diagram that illustrates digital circuitry related to a digital approach in accordance with one or more aspects of the present disclosure. In some examples, which approach is used may be dependent on how $t_{ON}$ is generated. (FIG. 6 actually includes both analog circuitry and digital circuitry.)

In the illustrated example of FIG. 5, $t_{ON}$ may measure input voltage 304 and to measure inductance of the choke inductance $L_1$ used indirectly. This is because on time, $t_{ON}$, is directly proportional to the choke inductance of inductor $L_1$ and is inversely proportional to input voltage 304.

Figure 7:
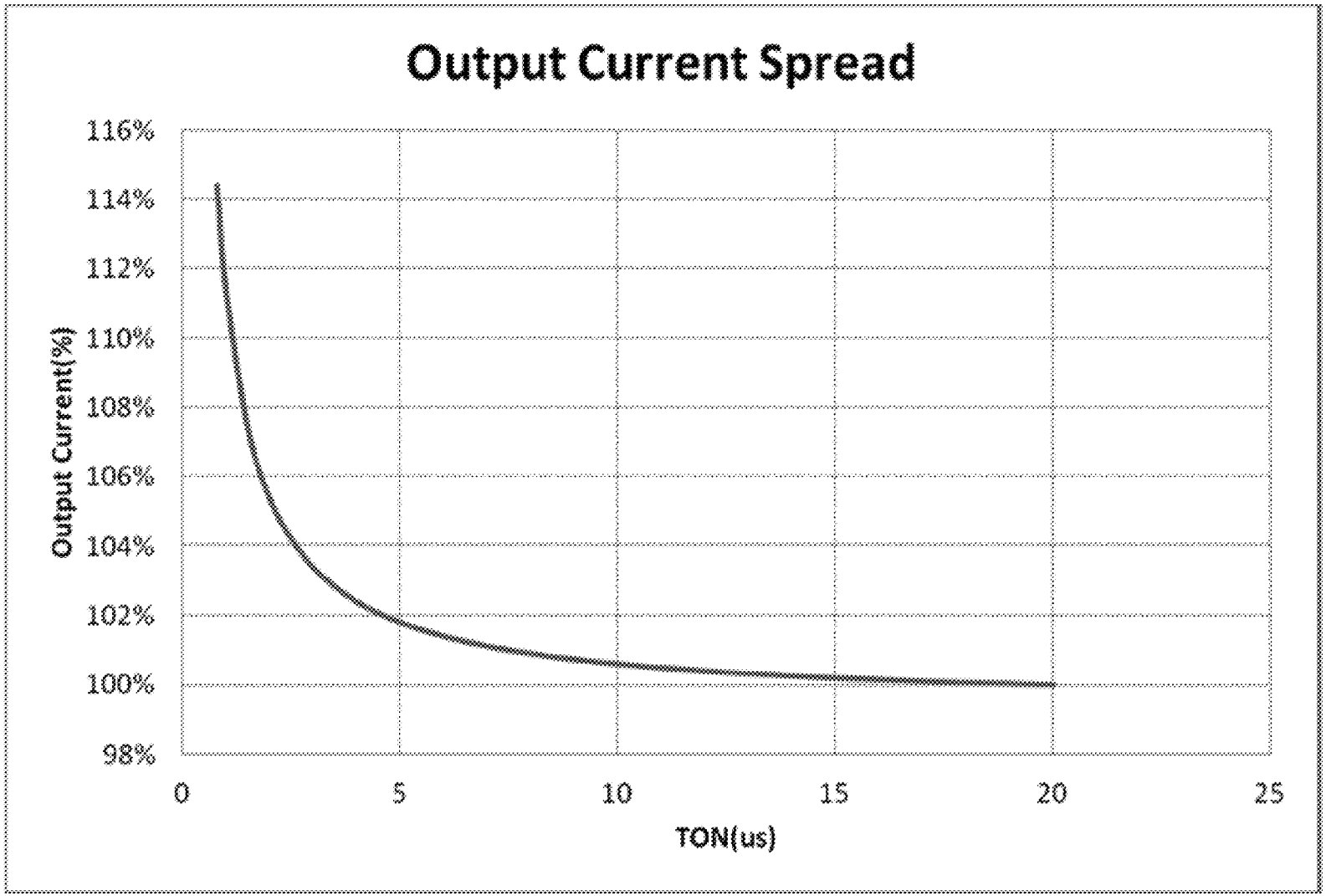
FIG. 7 is a graph illustrating an example output current spread with respect to $t_{ON}$ in accordance with one or more aspects of the present disclosure.

Accordingly, the on time, $t_{ON}$ signal may be to the gate signal of the transistor 502, e.g., through inverter 504. For example, the systems and methods described herein may measure the on time, $t_{ON}$, using an analog approach. An analog timer, e.g., a resistor and capacitor circuit ($R_5$ and $C_5$), may perform timing measurements to determine how long the gate of internal power MOSFET 352 is turned on. When the gate of internal power MOSFET 352 has been on for a predetermined amount of time, as determined by the R-C circuit, this information may be sent to the compensation logic block. In some examples, the information generated by the analog timer may be sent digitally. As illustrated in FIG. 5, when the gate signal is low, transistor 502 will be on and the capacitor may discharge to ground through transistor 502. When the gate signal is high, transistor 502 will be off and the capacitor may begin to be charged through resistor $R_5$. Voltage values for $V_{REF1}$ through $V_{REFN}$ may be selected so that a digital representation of the on time $t_{ON}$ may be generated. This digital representation of the on time $t_{ON}$ maybe used to select the gain select for the variable gain $V_{COMP}$ amplifier 354. In some examples, the voltages, $V_{REF1}$ through $V_{REFN}$ may be selected so that the output gain select is linearly related to the on time $t_{ON}$. This is not required, however. Other voltages, $V_{REF1}$ through $V_{REFN}$ may be selected, for example, based on the relationship between output current spread and on time $t_{ON}$. An example of such a relationship is illustrated in FIG. 7, described below. For the specific example of FIG. 7, the voltages, $V_{REF1}$ through $V_{REFN}$ may be selected so that the output gain select is linearly related to the on time $t_{ON}$.

As described above, FIG. 6 is a block diagram that illustrates circuitry related to a digital approach in accordance with one or more aspects of the present disclosure. The digital approach makes use of $t_{ON}$ generation digital bits to determine on time, $t_{ON}$. In the illustrated example, the signal on VCOMP pin of IC 306, which is output of the variable gain $V_{COMP}$ amplifier 354, is an input to an Up/Down Counter 602, which counts up or counts down based on the voltage at VCOMP pin of IC 306. Up/Down Counter 602 outputs a $t_{ON}$ select signal 604 that is an input to logic control for gain select 606 and circuitry 608. Two $t_{ON}$ select signals 604 are illustrated in FIG. 6. It will be understood, however, that in one example, $t_{ON}$ select signal 604 may be a single output connected to both logic control for gain select 606 and circuitry 608. In another example, $t_{ON}$ select signal 604 may be multiple outputs connected to logic control for gain select 606 and circuitry 608. Logic control for gain select 606 may use the $t_{ON}$ Select signal 604 to generate a gain select signal 610 that may select the gain of the variable gain $V_{COMP}$ amplifier 354. The $t_{ON}$ Select signal 604 may also be an input to circuitry 608 that is similar to the circuitry used in the analog approach discussed with respect to FIG. 5.

As illustrated in FIG. 6, an analog timer, e.g., a resistor array and capacitor array may be used to perform timing measurements to determine how long the gate signal is, for example, a logical high value. After a predetermined time, based on the capacitor array, resistor array, and $V_{REF}$ selected, a $Gate_{OFF}$ signal may be output to turn the gate of the external power MOSFET off.

FIG. 7 is a graph illustrating an example output current spread with respect to $t_{ON}$ in one example that is accordance with one or more aspects of the present disclosure. In the example of FIG. 7, the relationship of the output current with respect to $t_{ON}$ is illustrated assuming no change in input voltage. The values are based on a 120 ns propagation delay.

As described above, there may be a spread between the actual output current and the measured output current. The output current spread between the measured current and the actual current may be worse when $t_{ON}$ is short. When $t_{ON}$ is small, the spread may be larger and the actual output current may be higher than the measured output current. When $t_{ON}$ is longer, the actual output current may be nearer to the measured output current. Hence, there is a need to reduce the output current as $t_{ON}$ reduces. In the illustrated example, the output current is directly proportional to the peak $V_{CS}$ voltage. The peak $V_{CS}$ voltage may be reduced by increasing the gain of $V_{COMP}$ amplifier 354. When the gain of $V_{COMP}$ amplifier 354 is increased, a lower $V_{CS}$ peak voltage is required to ensure that the $V_{COMP}$ voltage reaches 1.5V. As $t_{ON}$ reduces, the output current will start to increase due to the external and internal propagation delay.

Figure 8:
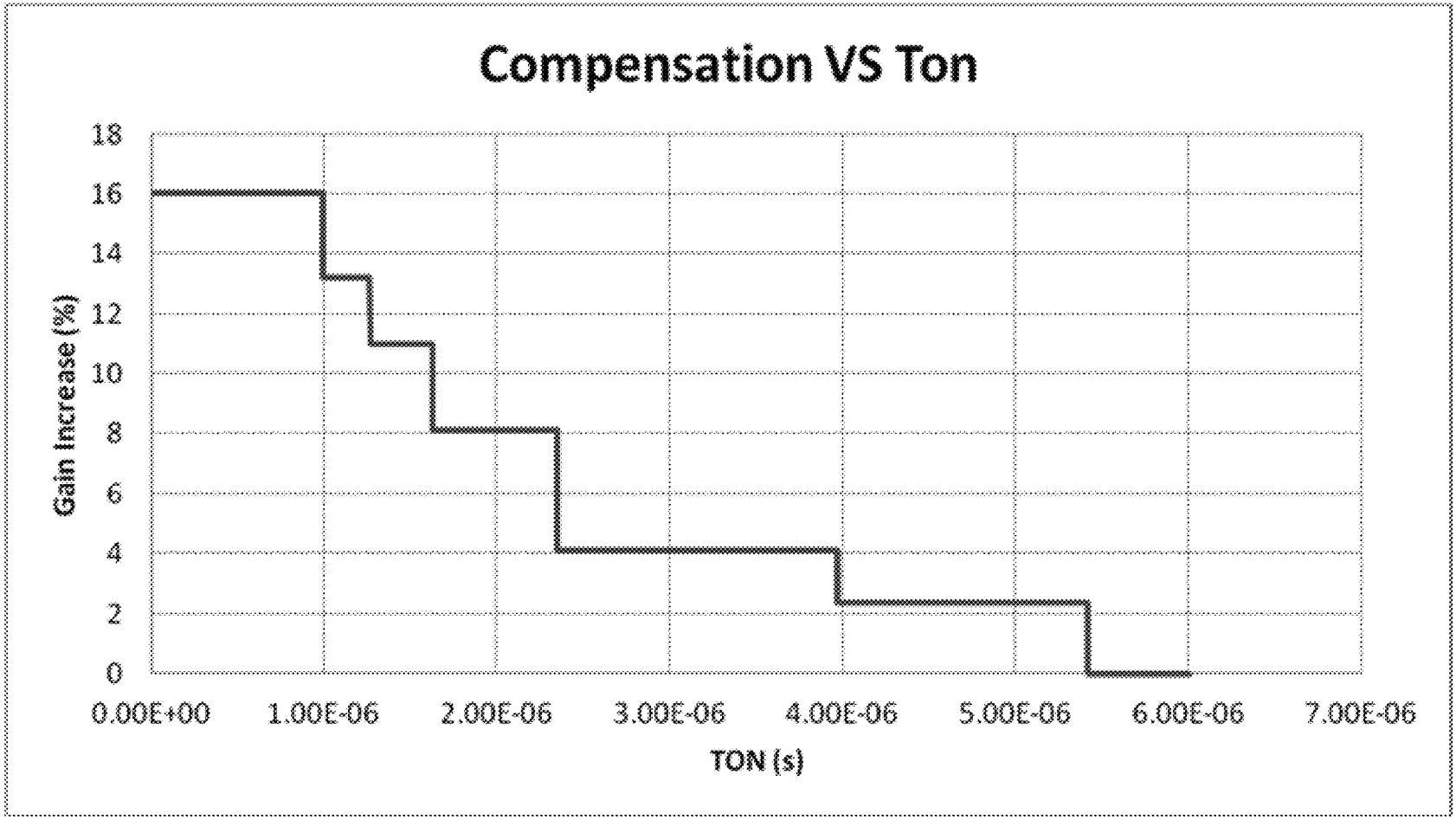
FIG. 8 is a graph illustrating an example of compensation with respect to $t_{ON}$ in accordance with one or more aspects of the present disclosure.

FIG. 8 is a graph illustrating an example of compensation with respect to $t_{ON}$ in accordance with one or more aspects of the present disclosure. The gain increase illustrated in FIG. 8 may generally be used to correct the output current spread illustrated in FIG. 7. As illustrated in FIG. 8, the gain increase percentage may be varied in a series of discrete steps. In other examples, the gain increase may be varied continually as $t_{ON}$ varies. This may generally be done for some range of values. As $t_{ON}$ increases the gain increase used may generally decrease. In some examples, there is no need to compensate for the whole range of the $t_{ON}$. This is because as $t_{ON}$ increases, the error contributed by the propagation delay will also reduce. Accordingly, there is no need for compensation at longer $t_{ON}$. Thus, generally, after some maximum value for $t_{ON}$ no gain increase is used. For a short $t_{ON}$, the gain is increased, thus reducing the output current. As a result, the output current may be compensated for the spread in the propagation delay. In the illustrated example of FIG. 8, the short on time for which some gain increase is used is in a range of from 0 to about 5.4 microseconds. Other ranges are possible and may be based on how the output current spread varies with on-time for a particular system.

As illustrated in FIGS. 7 and 8 the gain increases used may generally be selected to counter the output current spread (the difference between measured current and actual current). Accordingly, different gain increase used to correct for the output current spread may be used for different example systems and may be selected based on the output current spread for a particular system. Again, a continually varied gain increase may be used, or a series of discrete steps may be used. When a series of discrete steps is used they may roughly follow the output current spread of the particular system being implemented, however, a wide variety of gain increases may be used. These gain increases may also be selected in conjunction with selecting a particular value for $C_1$. $C_1$ is selected so as to reduce the spread in the output current may also be reduced, as needed based on any reductions in the spread in the output current and the measured output current introduced by the variable gain. For the reasons discussed above, it may generally be preferable to impart most of the reductions in the spread in the output current and the measured output current using the variable gain. This is not required, however.

As described herein, some examples introduce a variable gain for $V_{COMP}$ amplifier 354. This gain may be dependent on the $t_{ON}$. When the on time is short, the propagation delay may become a larger proportion of $t_{ON}$. As a result, the output current may be higher than expected. The gain is designed to increase when $t_{ON}$ reduces. In this way, the error due to propagation delay is compensated. As described herein, in some examples, little or no additional bill of materials cost is incurred. (In some examples, the cost of IC 306 may be greater than the cost of IC 106.) Additionally, in some examples, the spread of the output current can be adjusted externally by slightly adjusting the value of the $C_1$.

Figure 9:
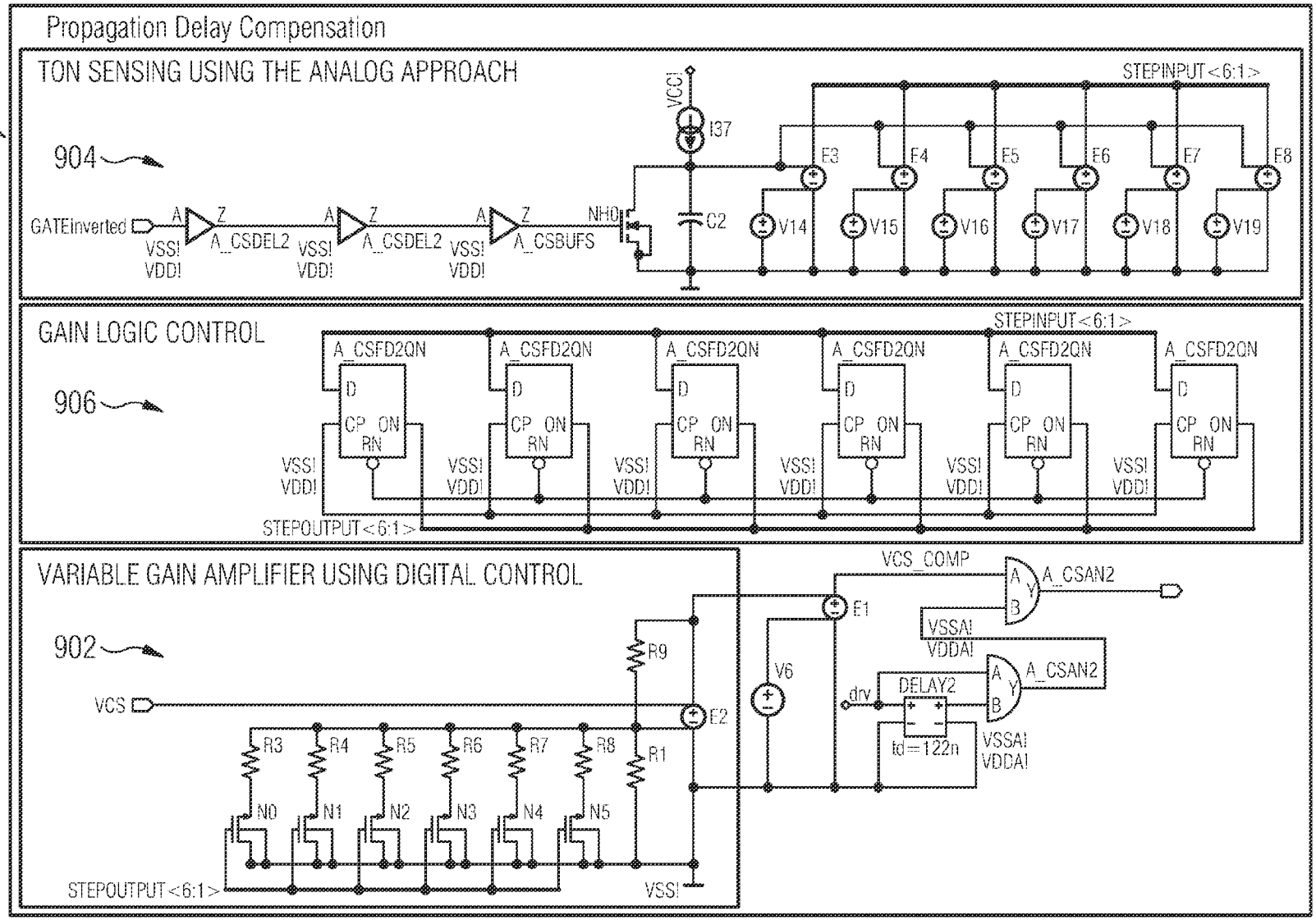
FIG. 9 is a block diagram that illustrates an example circuit diagram in accordance with one or more aspects of the present disclosure.

FIG. 9 is a block diagram that illustrates an example circuit diagram in accordance with one or more aspects of the present disclosure. The circuit of FIG. 9 models an example LED system 900. In the illustrated example, the $V_{CS}$ is passed through a variable gain amplifier 902. One possible example of the variable gain amplifier's gain relationship with $t_{ON}$ is illustrated in FIG. 8. The power MOSFET may be turned off when the amplifier output reaches 1.5V. In the illustrated example, the $t_{ON}$ sensing is done using an analog approach 904. The $t_{ON}$ may then be converted into a digital signal in Gain Logic Control Block 906. The information is then used to select the gain for the Variable Gain Amplifier.

Figure 10:
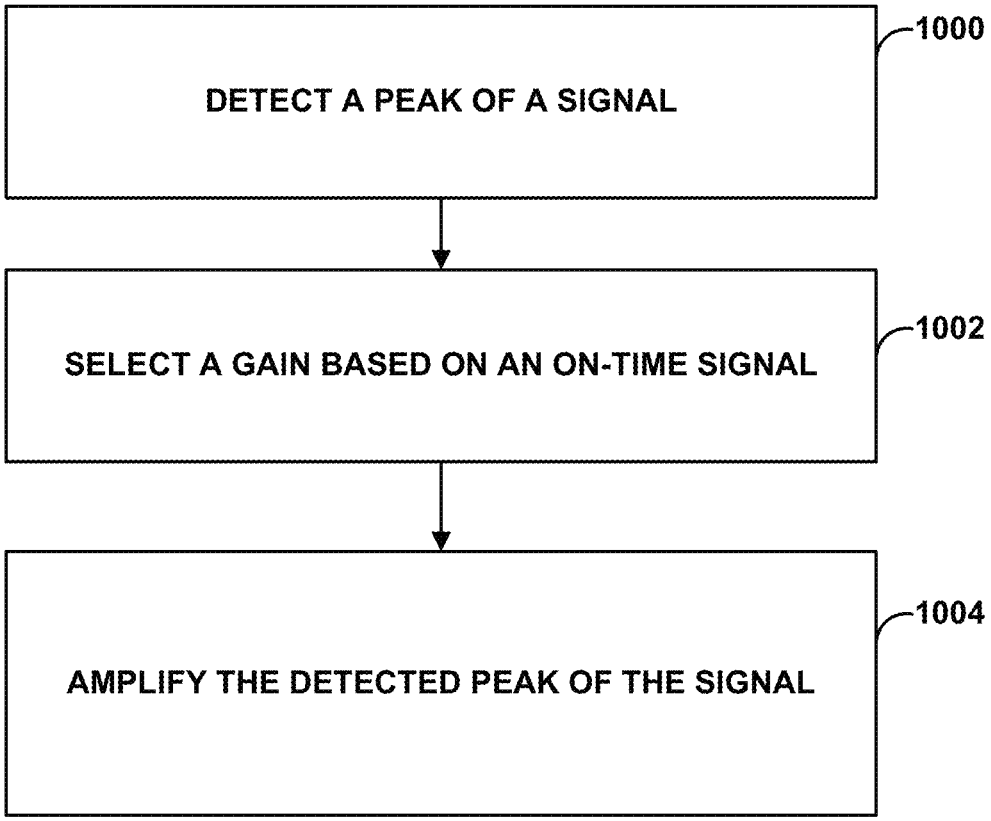
FIG. 10 is a flowchart illustrating an example method for controlling a current to an LED, in accordance with one or more aspects of the present disclosure.

FIG. 10 is a flowchart illustrating an example method for controlling a current to a light emitting diode (LED), in accordance with one or more aspects of the present disclosure. Peak detector 350 may detect a peak of a signal (1000). The signal comprise a signal that is representative of an on time, $t_{ON}$, of an LED. Some examples may measure the on time of the signal and using that measurement to select the gain of the variable gain amplifier. In some examples, On-time ($t_{ON}$) detector 358 measures the on time of the signal.

Gain selector 356 selects a gain for variable gain $V_{COMP}$ amplifier 354 based on the on-time signal (1002). In some examples, gain selector 356 may increase the gain of the variable gain amplifier for a short on time. Furthermore, as described herein some examples may use an analog approach and some examples may use a digital approach. For example, in order to select a gain for variable gain $V_{COMP}$ amplifier 354 based on the on-time signal, $t_{ON}$, may be sensed to measure input voltage 304. For example, the systems and methods described herein may measure the on time, $t_{ON}$, using an analog approach. An analog timer, e.g., a resistor and capacitor circuit ($R_5$ and $C_5$), may perform timing measurements to determine how long the gate of internal power MOSFET 352 is turned on. When the gate of internal power MOSFET 352 has been on for a predetermined amount of time, as determined by the R-C circuit, this information may be sent to the compensation logic block.

In some examples, a digital approach may be used in accordance with one or more aspects of the present disclosure. The digital approach may use $t_{ON}$ generation digital bits to determine on time, $t_{ON}$. In the illustrated example, the signal on the VCOMP pin of IC 306, which is output of the variable gain $V_{COMP}$ amplifier 354 is an input to an Up/Down Counter 602, which counts up or down based on the voltage at the VCOMP pin of IC 306. Up/Down Counter 602 outputs a $t_{ON}$ Select signal 604 that is an input to logic control for gain select 606 and circuitry 608. Logic control for gain select 606 may use the $t_{ON}$ Select signal 604 to generate a gain select signal 610 that may be used to select the gain of the variable gain $V_{COMP}$ amplifier 354. The $t_{ON}$ Select signal 604 may also be an input to circuitry 608 that is similar to the circuitry used in the analog approach discussed with respect to FIG. 5.

Variable gain $V_{COMP}$ amplifier 354 amplifies the detected peak of the signal (1004). By increasing the gain of $V_{COMP}$ amplifier 354, the output of the variable gain $V_{COMP}$ amplifier 354, i.e., the amplified detected peak value) may reach the reference voltage sooner, i.e., for a lower voltage input on the input of the variable gain $V_{COMP}$ amplifier 354. This translates to a lower output current value for a given comparison. Accordingly, the average output current will be lower for a shorter $t_{ON}$. Generally, in a system without variable gain for the $V_{COMP}$ amplifier (e.g., $V_{COMP}$ amplifier 164), a lower value for $t_{ON}$ will generally have a higher output current than measured. As is discussed in more detail with respect to FIG. 7. Accordingly, the gain of the variable gain $V_{COMP}$ amplifier 354 may be increased such that a lower output current value for a given comparison is closer to the actual output current. The increase in the gain of the variable gain $V_{COMP}$ amplifier 354 may be varied between lower values of $t_{ON}$ will and longer values of $t_{ON}$ such that the output current measured is generally closer to the actual output current.

A computer-readable storage medium may form part of a computer program product, which may include packaging materials. A computer-readable storage medium may comprise a computer data storage medium such as random access memory (RAM), synchronous dynamic random access memory (SDRAM), read-only memory (ROM), non-volatile random access memory (NVRAM), electrically erasable programmable read-only memory (EEPROM), FLASH memory, magnetic or optical data storage media, and the like. A computer-readable storage medium may comprise a non-transitory computer data storage medium. The techniques additionally, or alternatively, may be realized at least in part by a computer-readable communication medium that carries or communicates code in the form of instructions or data structures and that can be accessed, read, and/or executed by a computer. The computer readable storage medium may store instructions that upon execution by one or more processors cause the one or more processors to perform one or more aspects of this disclosure.

The code or instructions may be executed by one or more processors, such as one or more DSPs, general purpose microprocessors, ASICs, field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules. The disclosure also contemplates any of a variety of integrated circuit devices that include circuitry to implement one or more of the techniques described in this disclosure. Such circuitry may be provided in a single integrated circuit chip or in multiple, interoperable integrated circuit chips in a so-called chipset. Such integrated circuit devices may be used in a variety of applications.

Various examples have been described. These and other examples are within the scope of the following claims.

What is claimed is:

1. A device configured to control a semiconductor light source, the device comprising:

a peak detector;

a variable gain amplifier coupled to the peak detector and configured to amplify an output of the peak detector; and a gain selector, coupled to the variable gain amplifier and configured to control the variable gain amplifier by varying the gain of the variable gain amplifier based on an on time of a signal.

2. The device of claim 1, wherein the gain selector includes analog circuitry.

3. The device of claim 1, wherein the gain selector includes digital circuitry.

4. The device of claim 1, wherein the gain selector includes analog circuitry and digital circuitry.

5. The device of claim 1, further comprising an on-time detector configured to measure the on time of the signal.

6. The device of claim 1, the gain of the variable gain amplifier is increased for a short on time.

7. The device of claim 6, wherein the short on time comprises a range of from 0 to 5.4 microseconds.

8. A system comprising:

a light emitting diode (LED);

a power transistor coupled to the LED and configured to provide power to the LED;

a device coupled to the power transistor, the device including:

a peak detector;

a variable gain amplifier coupled to the peak detector and configured to amplify an output of the peak detector; and a gain selector, coupled to the variable gain amplifier and configured to control the variable gain amplifier by varying the gain of the variable gain amplifier based on an on time of the LED.

9. The system of claim 8, wherein the gain selector includes analog circuitry.

10. The system of claim 8, wherein the gain selector includes digital circuitry.

11. The system of claim 8, wherein the gain selector includes analog circuitry and digital circuitry.

12. The system of claim 8, further comprising an on-time detector configured to measure the on time of the LED.

13. The system of claim 8, the gain of the variable gain amplifier is increased for a short on time.

14. The system of claim 13, wherein the short on time comprises a range of from 0 to 5.4 microseconds.

15. A method of controlling a current to a semiconductor light source comprising:

detecting a peak of a signal;

selecting a gain for a variable gain amplifier based on an on-time signal;

amplifying the detected peak of the signal;

measuring the on time of the signal; and using that measurement to select the gain of the variable gain amplifier.

16. The method of claim 15, further comprising increasing the gain of the variable gain amplifier for a short on time.

17. The method of claim 16, wherein the short on time comprises a range of from 0 to 5.4 microseconds.

18. A device for controlling a current to a semiconductor light source comprising:

means for detecting a peak of a signal;

means for selecting a gain for a variable gain amplifier based on an on-time signal;

means for amplifying the detected peak of the signal; and means for increasing the gain of the variable gain amplifier for a short on time.

19. The device of claim 1, wherein the on time of the signal comprises an on time of a signal associated with a light emitting diode.

20. The device of claim 1, wherein the on time of the signal comprises an on time of a signal associated with a power transistor.

* * * * *